US005735401A

United States Patent [19]

Cassou et al.

[11] Patent Number: 5,735,401

[45] Date of Patent: Apr. 7, 1998

[54] MACHINE FOR MAKING UP READY TO USE DOSES OF ANIMAL SEMEN AND DOSE OF SEMEN MADE UP BY THIS MACHINE

[75] Inventors: Robert Cassou; Maurice Cassou; Bertrand Cassou, all of L'Aigle, France

[73] Assignee: Instruments de Medecine Veterinaire, L'Aigle, France

[21] Appl. No.: 574,869

[22] Filed: Dec. 19, 1995

[30] Foreign Application Priority Data

Dec. 23, 1994 [FR] France ..... 94 15621

[51] Int. Cl.[6] ..... B65D 73/00

[52] U.S. Cl. ..... 206/469; 206/484; 383/207; 383/209

[58] Field of Search ..... 206/438, 469, 206/484; 215/47, 49; 383/36, 200, 201, 207, 209

[56] References Cited

U.S. PATENT DOCUMENTS

| | | | |
|---|---|---|---|
| 3,184,121 | 5/1965 | Volckening | 206/484 |
| 3,721,360 | 3/1973 | Collie | 215/49 |
| 4,686,814 | 8/1987 | Yanase | 383/36 |
| 4,797,309 | 1/1989 | Kammerer et al. | 206/484 |
| 4,921,137 | 5/1990 | Heijenga | 206/469 |
| 4,974,732 | 12/1990 | Sullivan et al. | 206/484 |
| 4,995,519 | 2/1991 | Rose et al. | 215/47 |

FOREIGN PATENT DOCUMENTS

| | | |
|---|---|---|
| 567376 | 5/1958 | Belgium . |
| 480798 | 10/1991 | European Pat. Off. . |
| 2127570 | 1/1972 | France . |
| 2667843 | 7/1991 | France . |

*Primary Examiner*—David T. Fidei

*Attorney, Agent, or Firm*—Bachman & LaPointe, P.C.

[57] ABSTRACT

A machine to make up doses of semen in a container comprising welded thermoplastics films that can be opened by hand without using instruments in order to insert therein an insemination probe includes a tubular needle having a nozzle over which is threaded a cleaning ring to prevent coating of a region to be sealed by welding with semen and to keep the walls of the thermoplastics films dry after filling the dose with semen. The sealing weld is made by a device having inverted U-shape jaws. An incision perpendicular to the branches of the U-shape is made at the same level as the latter by an incision device including an orientable blade.

6 Claims, 2 Drawing Sheets

MACHINE FOR MAKING UP READY TO USE DOSES OF ANIMAL SEMEN AND DOSE OF SEMEN MADE UP BY THIS MACHINE

BACKGROUND OF THE INVENTION

1. Field of the Invention

The invention concerns an improvement in the making up of ready to use doses of animal semen for artificial insemination, to be more precise a machine for making up such doses and the doses made up by the improved machine.

2. Description of the Prior Art

Artificial insemination using ready to use doses of semen to which a probe is fitted at the place of insemination has become standard practise, in agriculture in particular.

Doses made up in strips including sachets made from two films of flexible thermoplastics material fixed together by welds each delimiting a pocket with an approximately rectangular contour with one of the shortest sides interrupted are known in themselves and in these doses the weld defines, leading towards the exterior of the pocket from the interruption in the shorter side, a filler tube extended by a centering funnel widening in the direction away from the bottom of the rectangular pocket; the two films of thermoplastics material have holes outside the line of the weld for sprockets which feed the strip along the making up machine, and in particular into the station in which the pockets are filled; the two films are also welded together around these holes, locally increasing the stiffness of the strip and reducing the tendency of the strip to deform in this area during filling. As the sachets are still in a strip when filled, it is important to facilitate deformation of the pocket during this operation and, to this end, a long incision that subsequently delimits each sachet is made in the strip, transversely to the strip and between the successive pockets. The pockets are sequentially filled with semen, in conjunction with stepwise movement of the strip into the filler station, by means of a tubular needle connected to a tank of semen and introduced into the pockets in succession while the sachets are stationary in the filler station; to this end the needle is moved in longitudinal translation to insert its free end into the filler tube, remains stationary during filling, and is then moved in longitudinal translation in the opposite direction to withdraw it from the tube; in the next station the machine for making up the doses welds the two films of thermoplastics material together to join together the opposite walls of the centering funnel, forming a weld which closes and therefore seals the pocket.

The sachets are then separated by extending the incisions and then constitute doses ready for use.

When the doses are to be used, scissors, a stylet or any other cutting tool are used to make a transverse cut through the upper part of the centering funnel, for example a V-shape cut or even a straight cut, after which the free end of the tube of the probe is inserted into the filler tube of the dose via the funnel that has been opened up in this way.

The operations required are therefore simple and fast and the probe can be fitted to the dose in a very short time, which greatly reduces the risk of contamination of the semen by bacteria in the surrounding air, and insemination can begin immediately afterwards; insemination itself is also simple and fast and, the dose being held higher than the end of the probe, it is drained naturally by the combined action of atmospheric pressure, genital tractus of the animal and the intrinsic shape of the pocket, which is flat with no excess volume, and with no need for replacement of a volume of semen by the same volume of air as the semen flows out.

However, reservations have been expressed by some users, relating to the necessity of using a cutting tool at the place of insemination, since it is not possible to keep the tool sterile throughout the insemination of several animals, or even a large number of animals.

An object of the invention is to remedy this drawback and consequently to provide a ready to use dose of animal semen that avoids the use of a tool for opening it. As the problems to be solved to produce a dose of this kind are more difficult to solve than might be supposed at first sight, the invention is more particularly concerned with improvements to a machine for making ready to use doses of semen and the doses made up by means of that machine.

SUMMARY OF THE INVENTION

The invention therefore consists in a machine for making up ready to use doses of animal semen supplied with empty sachets each including a filler tube extended upwards by a funnel, said machine including a filler station equipped with a tubular needle connected to a tank of semen and which is moved in longitudinal translation to insert its free end into the filler tube, immobilized during filling with semen, and moved in longitudinal translation in the opposite direction to remove it from the tube, in which machine the free end of the tubular needle is the free end of a nozzle slidably mounted inside a cleaning ring so that on raising the nozzle after filling the sachet, after the free end of the nozzle has reached the free end of the ring, no residue of semen remains on the outside of the nozzle that can soil the next sachet prior to welding, said machine further including inverted U-shape welding members for sealing the dose by making a weld of the same shape extending upwardly the contour of the funnel and an incision device including a blade mobile in a plane approximately perpendicular to the longitudinal axis of the dose, which plane intersects the branches of the U-shape of the weld that seals the dose.

Since, because of these features, the inside faces of the sachet are kept dry above the level of the flow tube and the weld is of inverted U-shape, when the dose is opened manually the two films constituting the sachet have the greatest possible chance of tearing in two different directions that are always transverse to the funnel.

The invention also concerns a dose of animal semen made up by a machine as defined hereinabove, of the type in which the semen is contained in a sachet made of two films of thermoplastics material welded together by a weld delimiting a pocket to which a filler tube extended by a funnel is connected, which semen dose includes an inverted U-shape sealing weld the branches of which intersect the part of the weld delimiting the funnel in its widest part, an incision approximately perpendicular to the branches of the inverted U-shape and internal walls that are dry at least between said branches of the inverted U-shape.

This dose can therefore be opened without using any instrument, and faster than prior art doses; moreover, this property is obtained without producing a fragile part of .the sachet large enough to increase significantly the risk of unintentional opening of the dose.

Other features and advantages of the invention will emerge from the following description of one embodiment of the invention given by way of non-limiting example and shown in the appended drawings.

DETAILED DESCRIPTION OF THE PREFERRED EMBODIMENT

The problem of enabling simple opening of a sachet without the use of an instrument that may be contaminated to a varying degree is usually solved by providing either a row of perforations between the two areas to be separated or a place to start tearing from one edge of the sachet, for example in the form of a slit extending in the direction in which the tear is to be made, or a V-shape incision pointing in that direction.

In the present case the provision of a row of perforations, which would have to pass through the upper part of the pocket, is naturally inappropriate, since the sachet would not longer be sealed. Furthermore, the presence of a place to start tearing from one edge of the sachet would make the sachet much more fragile since a traction force applied from one side (or traction forces applied from both sides) of this place, even if relatively weak, would first extend the tear and repeated tearing forces would gradually extend it as far as the weld sealing the dose and then, beyond this weld, across the funnel, which would eventually cause unwanted opening of the dose.

Figure 1:
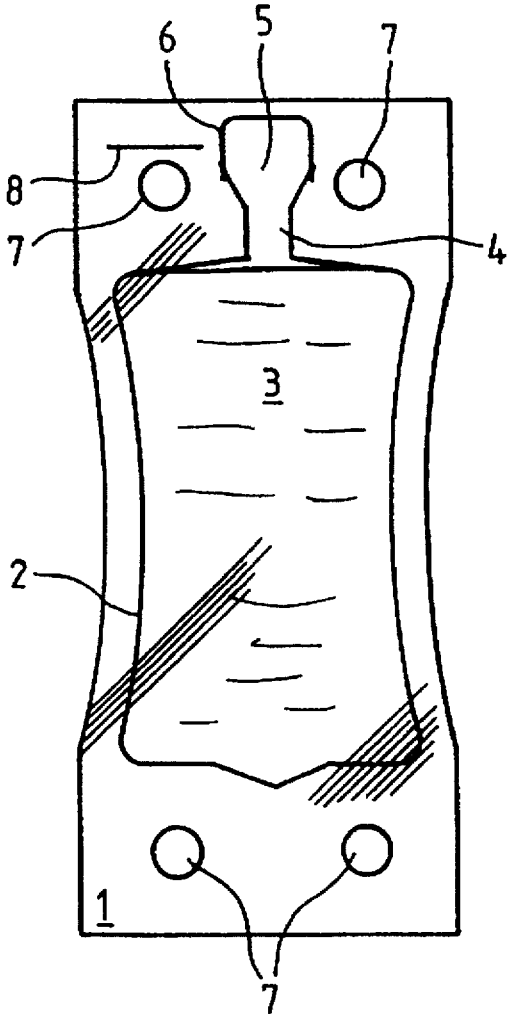
FIG. 1 is a front view of a ready to use dose of animal semen in accordance with the invention.
Figure 4:
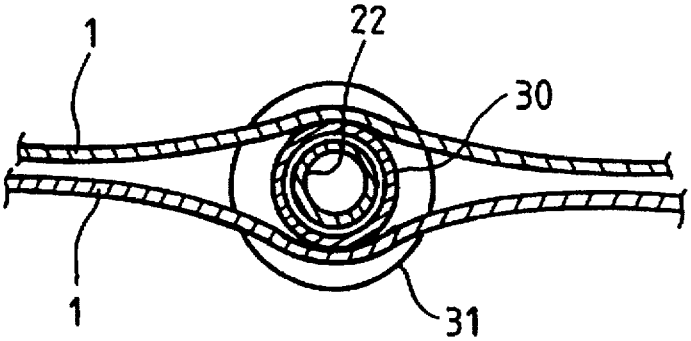
FIG. 4 is a diagrammatic view to a larger scale in section on the line IV—IV in FIG. 3.

Thus it has been found that although the solutions of providing an area of reduced strength, such as a slit, might seem of interest, to avoid the unfavorable consequences of inevitable manufacturing inaccuracies this area must not reach the edge of the sachet or the sealing weld. This is why it has been considered desirable to provide a single incision that does not reach the edges of the dose and is outside the weld delimiting the pocket. This incision naturally extends in the direction in which tearing is required. FIG. 1 shows a dose including an incision of this kind.

This figure shows a dose cut from a strip made from two films of thermoplastics material (these can be composite films), the pieces of the film 1 that make up the dose, for the sake of simplicity referred to as "films" in the remainder of this description, being fixed face-to-face by a weld 2 delimiting a pocket 3 which is approximately rectangular when empty; the shorter side opposite the bottom of the sachet is interrupted in the center and the weld 2 defines, in this area, a filler tube 4 extending to the exterior of the pocket from the interruption, with edges parallel to the longer median line of the rectangle constituting the longitudinal axis of symmetry of the pocket, followed by a funnel 5 widening in a V-shape away from the bottom of the pocket; when the dose is filled with liquid the sides of the rectangle are deformed, imparting a "pillow" shape to the dose; a weld 6 to seal the dose joins the opposite sides of the funnel 5 at the wider end of the latter. The two thermoplastics material films 1 have four circular holes 7 outside the approximately rectangular shape of the weld; two of these holes are above the shorter side of the rectangle interrupted by the filler tube, one on each side of the centering funnel 5, and the other two are below the shorter side constituting the bottom of the pocket, with the same distance (in the order of four to five centimeters) between them; each of the holes 7 is surrounded by a weld.

An incision 8 extends perpendicularly to the longer median line of the rectangle, at a level above the top of the funnel 5; accordingly, a tear in this direction perpendicular to the longer median line reaches the weld fixing the films 1 together in the area of the sealing weld 6 rather than in the area of the centering funnel 5, which prevents excessive damage to the latter; to obtain a good "grip" to facilitate guidance of the tear in the correct direction, it is preferable to begin by tearing the sachet towards the nearer edge; the length of the incision 8 is in the order of two centimeters, with the result that this first phase of tearing the thermoplastics material films can be accomplished by the user simply inserted a finger into the incision and pulling on the wall of the latter; an incision too short to allow insertion of the user's finger would make tearing difficult because of the relatively high mechanical resistance of the thermoplastic material, chosen for its strength and resistance to external attack (moisture, gas, viruses) to protect the doses.

However, given these conditions, if the tear reaches the sealing weld 6 the direction of this weld has a great influence on further tearing; to be more precise, the tear generally continues along the weld unless the latter extends (as in FIG. 1) virtually perpendicular to the direction of the tear (and therefore parallel to the longitudinal axis of the dose); note that even if the tear crosses the weld 6 in the correct direction, this "guiding" effect can be provoked by the wall of the weld inside the funnel, and therefore inverted V-shape welds, rectilinear welds in the upper part of the funnel and curved welds are absolutely to be avoided.

Also, in accordance with the invention, the sealing weld 6 is formed as shown in FIG. 1 as an inverted U-shape the free ends of the parallel branches of which join without discontinuity to the ends of the weld defining the funnel 5 at their points of greatest separation.

As a result, after crossing the weld 6, the tear continues in a random direction which is usually different than that of the weld, and it is statistically certain that it will cross the gap between the parallel branches of the inverted U-shape.

Under these conditions, however, it is difficult to separate the two films that are in contact in the area between the parallel branches of the U-shape to insert the tube of the probe between them. In addition to the forces of attraction between the two films (molecular, electrostatic, etc) related to their smooth surface and the nature of the material from which they are made, there is in practise also the adhesion force due to the presence of a thin film of semen in the lower part of the sachet.

For this reason, and also because the walls to be welded must be dry for the quality of the weld to be as good as possible and therefore for the self-separation to be as perfect as possible, it is therefore necessary to prevent the presence of semen (or any other liquid), however small in quantity, between the branches of the inverted U-shape or even inside the funnel 5 and outside the sachet.

Experience shows that under normal conditions for storing and manipulating doses of semen the presence of a film of semen in the region in question is due in most cases to the fact that semen residue at and around the end of the tubular filler needle after interruption of the feed of semen to the needle to fill the pocket is involuntarily deposited through contact of the needle with the films as the needle passes between the latter; the soiling outside the weld pollutes and contaminates the machine, the feed system can become blocked and problems can arise with feeding of the sachets because of this soiling, since the dilutant mixed with the semen includes sugar; finally, this soiling also pollutes and contaminates the content of the sachet when the latter is opened.

Trials including the necessary precautions to keep the inside of the funnel 5 and the inverted U-shape of the weld 6 and the outside of the sachet perfectly dry show that the films 1 separate much more easily if the tear continues beyond the weld in different directions; this surprising effect is attributed to the fact that the non-homogeneous nature of the material at the transition between the weld and the interior area of the pocket mentioned above is sufficiently large for the random directions in which the tear continues in the two films to be different, whereas previously this effect was compensated by the fact that the two films were "stuck together", behaving as a single film and therefore tearing in the same direction. The tendency to tear in two different directions can be further enhanced by making the sachets from two films of slightly different thickness, or even by orienting the slit in a direction slightly inclined (meaning less than about 10°) to the direction perpendicular to the branches of the U-shape, a greater angle leading to the drawbacks associated with an inverted V-shape sealing weld.

In conclusion, easy opening of the dose without use of instruments requires:

an incision extending in an appropriate direction, a weld also extending in an appropriate direction, approximately perpendicular to that of the incision and on a line through the incision, perfectly dry inside faces of the film in the tear area.

To this end, the machine for making up doses is essentially provided with:

a blade mounted on a blade support to make the incision, two heated jaws having an inverted U-shape profile to make the sealing weld after the pocket is filled, a tubular filler needle with a cleaning member to prevent the deposit of droplets on the inside face of the films above the filler tube.

Figure 2:
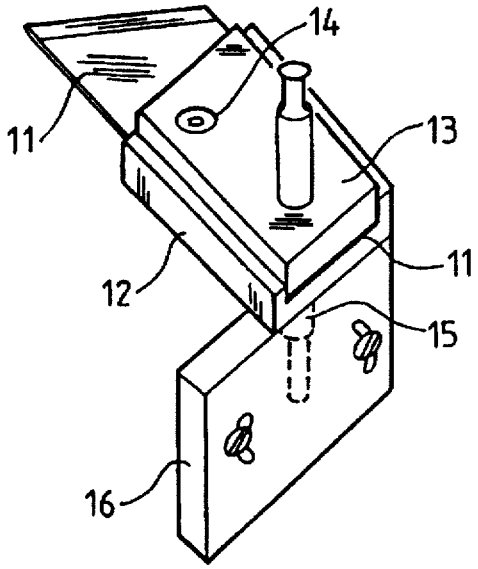
FIG. 2 is a perspective view showing an incision device of a machine in accordance with the invention for making up ready to use doses.

The incision device shown in FIG. 2 includes an interchangeable right-angle trapezium-shape blade 11 the cutting edge of which is the side inclined relative to the two parallel sides and part of the opposite end of which is accommodated at the back of a housing extending the full length of a generally parallelepiped-shape support plate 12; this housing is only just wider than the blade, but much deeper than the latter; a cover plate 13, also of generally parallelepiped-shape, is disposed in the housing on top of the blade so that the latter is clamped between the plate 12 and the cover plate 13. The blade is fixed by screws 14 the head of which bears on the cover plate or in a housing therein and the shank of which passes through existing openings in the blade (the blade can be a standard blade designed to fit knives known in the trade as "Stanley knives", for example) and screwed into screwthreaded holes in the plate. This blade support is mounted on the making up machine by means of a single-part or two-part spindle 15 passing through it, carried in a bearing of a base 16 so that the blade 11 can move with its support and its base 16 in a plane approximately perpendicular to the longitudinal axis of the dose and intersecting the plane of the sachet above the widest part of the funnel 5; its inclination (a few degrees maximum) is Preferably modifiable by pivoting the base 16.

The heated jaws can be of a temperature-controlled type pressed onto the film in a manner known in itself to make an inverted U-shape weld; to this end their facing areas adapted to press the thermoplastics films together themselves have an inverted U-shape.

Figure 3:
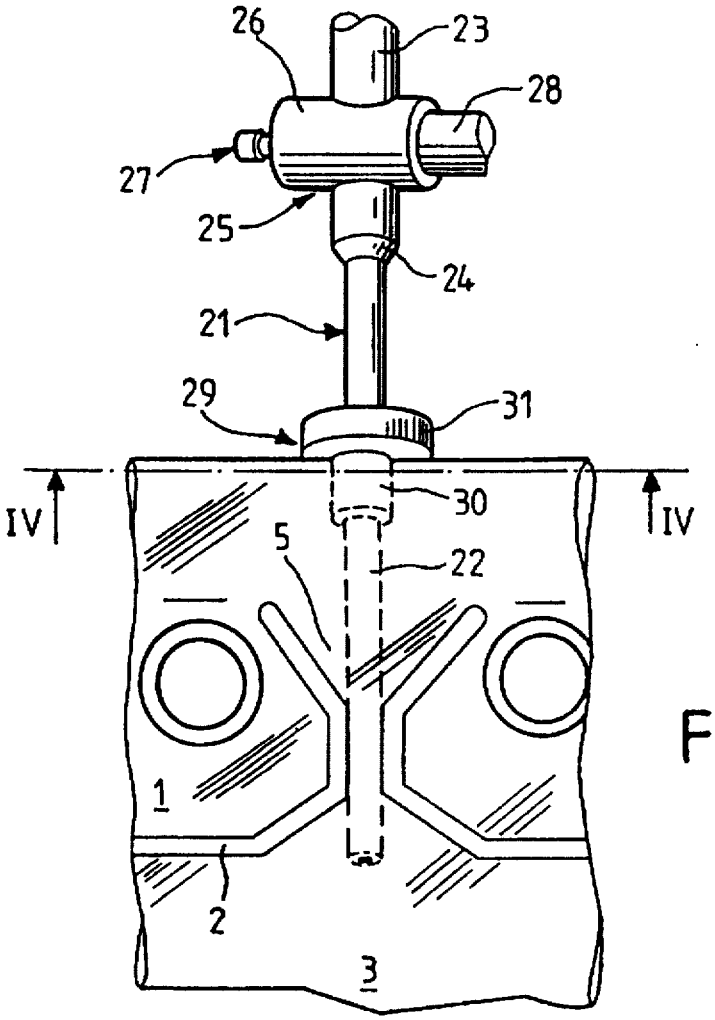
FIG. 3 is a perspective view showing part of a clean fill device of the machine in accordance with the invention for making up doses.

The clean fill device equipping the filler station shown in FIG. 3 includes a tubular needle 21 connected to a tank of semen (not shown) having a nozzle 22 a few centimeters long adapted to be inserted into the filler tube 4 of the dose and a larger diameter semen feed part 23 joined to the nozzle by a shoulder or (preferably) a frustoconical transition 24. The tubular needle 21 is carried by the making up machine through a shouldered needle-carrier 25 having a larger diameter part 26 with a diametral hole through the semen feed part 23 which is fixed to it by means of a screw 27 extendably axially in this larger diameter part and a smaller diameter part 28 fixed in the machine and having a lateral groove (which cannot be seen in the figure) extending in the same direction as the longitudinal axis of the needle. The cleaning member is a removable and discardable ring 29 made from a synthetic material such as that available under the trade name DELRIN, held by a support (not shown) consisting of two flanges disposed face-to-face and defining a corridor between them along which runs the upper part of the strip of sachets including the filler tube and the funnel; the needle 21 slides in this ring (fitting in it with a slight clearance); at the end adjoining the free end of the nozzle this ring 29 has a smaller diameter region 30 adapted to be inserted between the two films of thermoplastics material; at its opposite end is a fixing flange 31 by means of which it is retained in its support; the hole in the ring 29 includes, at the top of the flange, a small supporting bevel acting as an abutment for the frustoconical transition 24 in the needle 21. To fill the sachet the tubular needle 21 moves down along its longitudinal axis and is inserted between the two films 1, firstly in the funnel 5 and then in the tube 4, until the frustoconical transition 24 abuts against the bevel in the flange 31 of the ring 29, the smaller diameter region 30 of which is inserted between the two films: filling is then carried out; when the semen reaches the required level, the tubular needle 21 is moved upwards in longitudinal translation and almost inevitably has at least one droplet of semen at the free end of and around the nozzle 22; when the free end of the nozzle 22 reaches that of the ring 29 either the residual droplet is semen is detached from the nozzle 22 by the free end of the smaller diameter region 30 of the ring or continued upward movement in translation of the nozzle withdraws the droplet inside the ring; if the quantity of residual semen is relatively large, some is detached and drops back into the pocket and/or is deposited in the filler tube and some is retracted into the ring, but the funnel and the area of the sealing weld remain dry; when the upper part of the dose is crushed during welding no liquid film extends this far and it follows that no liquid film extends any further than this. When the base of the nozzle has reached an upper level at the base of the ring, the operation can continue (by making the inverted U-shape seal and the incision in the sachet that has just been filled) and another sachet can be filled, the filler needle moving downwards again through the ring without its external wall being soiled by the semen, with the result that the faces of the films constituting the sachet remain free of soiling by semen.

To conclude, the removable and discardable cleaning ring ensures that the two walls of the films constituting the sachet remain dry during filling and that a perfect U-shape weld is obtained. As the two branches of the U-shape are perfectly welded, self-separation is achieved under ideal conditions and the break in the first film is always lower than that in the bottom film, whereas if the films were wet when welded the two films would tear in parallel directions and the insertion of the insemination probe would become problematic.

Of course, the invention is not limited to the embodiments described above and shown and other embodiments can be envisaged without departing from the scope of the invention.

There is claimed:

1. Dose of animal semen of the type in which said semen is contained in a sachet made of two films of thermoplastics material welded together by a weld delimiting a pocket to which a filler tube extended by a funnel is connected, which semen dose includes an inverted U-shape sealing weld the branches of which intersect the part of said weld delimiting said funnel in its widest part, an incision approximately perpendicular to the branches of said inverted U-shape sealing weld and internal walls that are dry at least between said branches of said inverted U-shape sealing weld, wherein a first end of said incision is at a distance from an edge of said dose and a second end of said incision is at a distance from said U-shape sealing weld.

2. Animal semen dose of the type in which said semen is contained in a sachet made of two films of thermoplastics material welded together by a weld delimiting a pocket to which a filler tube extended by a funnel is connected, which semen dose includes an inverted U-shape sealing weld the branches of which intersect the part of said weld delimiting said funnel in its widest part, an incision approximately perpendicular to the branches of said inverted U-shape and internal walls that are dry at least between said branches of said inverted U-shape sealing weld, wherein a line through said incision intersects said branches of said inverted U-shape sealing weld above the level of the widest part of said funnel.

3. Dose of animal semen according to claim 1 wherein said films of thermoplastics material are different thicknesses.

4. Animal semen dose of claim 1 wherein a line through said incision intersects said branches of said inverted U-shape sealing weld at a level above said funnel.

5. Animal semen dose of claim 1 further comprising:

said funnel having a V-shape and being formed by two diverging welds;

each of said diverging welds having a first end connected to said filler tube and a second end;

said U-shape sealing weld having two parallel branches; and each of said parallel branches having a free end which joins without discontinuity to one of said second ends of said diverging welds.

6. Animal semen dose of claim 1 wherein said incision is dimensioned to allow a user to insert a finger into the incision.

* * * * *